United States Patent [19]

Carlson

[11] Patent Number: 4,648,740

[45] Date of Patent: Mar. 10, 1987

[54] MANHOLE LID SEAL

[76] Inventor: Franklin J. Carlson, W36854 Cherokee Rd., Oconomowoc, Wis. 53066

[21] Appl. No.: 835,370

[22] Filed: Mar. 3, 1986

[51] Int. Cl.[4] ..... E02D 29/14

[52] U.S. Cl. ..... 404/25; 52/19; 277/165; 277/170

[58] Field of Search ..... 404/22–26; 52/19–21; 277/165, 170–172, 215

[56] References Cited

U.S. PATENT DOCUMENTS

| | | | |
|---|---|---|---|
| 3,058,752 | 10/1962 | Miller | 277/171 |
| 3,150,889 | 9/1964 | Watts | 277/170 X |
| 3,308,727 | 3/1967 | Hurt, Jr. | 404/25 X |
| 3,927,891 | 12/1975 | Larker et al. | 277/215 X |

FOREIGN PATENT DOCUMENTS

| | | | |
|---|---|---|---|
| 474055 | 10/1937 | United Kingdom | 277/172 |
| 1552406 | 9/1979 | United Kingdom | 404/25 |
| 2088446 | 6/1982 | United Kingdom | 52/20 |
| 2092649 | 8/1982 | United Kingdom | 52/20 |
| 2102479 | 2/1983 | United Kingdom | 52/20 |

*Primary Examiner*—Stephen J. Novosad
*Assistant Examiner*—John F. Letchford
*Attorney, Agent, or Firm*—Andrus, Sceales, Starke & Sawall

[57] ABSTRACT

An improved manhole seal for sealing a manhole lid to the frame. The frame has an upwardly facing ledge and an annular surface bordering the outer extremity of the ledge. The lid encloses the manhole and has a lower surface seated directly on the ledge and an outer peripheral surface abutting the annular surface of the frame. In addition, the lid is provided with an angular surface which interconnects the lower surface and the outer peripheral surface. An annular gasket seals the lid to the frame and has a generally triangular cross section. The gasket includes a first surface resting on the ledge, a second surface disposed in engagement with the annular surface of the frame and a third diagonal surface which is disposed in engagement with the angular surface on the lid. The angularity of the third surface of the gasket with respect to the horizontal, is greater than the angularity of the angular surface on the lid to provide a positive seal between the members.

5 Claims, 3 Drawing Figures

MANHOLE LID SEAL

BACKGROUND OF THE INVENTION

Manholes in a roadway that are connected to a sewage disposal system are enclosed with a cast iron lid or cover. In the past, the manhole lids have been provided with one or more vent holes for the purpose of venting sewer gases through the lid to the atmosphere. However, it has been found that during heavy rains or flooding conditions, surface water will enter the manholes through the vent holes in the lid, as well as through the joint between the lid and the manhole frame, and the added surface water can seriously overburden the sewage system. Under these conditions, the excess effluent containing raw sewage is discharged directly into lakes or streams without treatment.

Because of this, the recent trend has been to seal the vent holes in the lid, as well as sealing the lid to the manhole frame, to prevent surface water from entering the sewage system. The lid rests on a shoulder or ledge formed in the cast iron manhole frame, and in one proposed sealing system, an O-ring seal is inserted within a groove formed in the under surface of the lid. The O-ring bears against the ledge on the frame to provide a seal between the lid and the frame.

In service, there is considerable rotation of the manhole lid relative to the frame due to vehicular traffic on the roadway. Vehicle tires contacting one edge of the lid and accelerating or deaccelerating will cause the lid to rotate. With the use of an O-ring seal, as previously described, the seal can be worn or torn due to the rotation.

A further problem with the O-ring seal arises during removal and replacement of the lid from the frame. The lid is normally removed by inserting a pick or other instrument into a recess in the lid to pry the edge of the lid upwardly and the lid is then pulled across the frame for complete removal. Dragging the lid across the frame can cause the O-ring seal to rip or tear, and in some cases the seal can be completely dislodged from the groove and may be lost down the sewer. A seal accidentally dropped into the sewer can clog the sewer or damage pumps.

SUMMARY OF THE INVENTION

The invention is directed to an improved manhold lid seal for sealing the peripheral edge of the manhold lid to the frame. In accordance with the invention, an annular seal or gasket having a generally triangular cross section, is positioned on the upwardly facing ledge of the manhole frame. The seal includes a lower surface which rests on the ledge, an outer peripheral surface which bears against the annular surface of the frame bordering the ledge, and a diagonal surface which is disposed at an angle of about 30° to 60° with respect to the horizontal.

The outer peripheral edge of the lid is formed with an angular surface that engages the diagonal surface of the seal and the angular surface has an angularity of about 20° to 50° with respect to the horizontal, with the angle being 5° to 15° less than the angle of the diagonal surface on the seal or gasket.

The angular relationship between the angular surface on the lid and the diagonal surface on the gasket provides a positive seal between the lid and the manhole frame.

As a further advantage, the gasket or seal can be applied to the ledge on the frame without the use of any adhesive or sealant.

As the lid is supported on the ledge of the frame, rotation of the lid can occur without damage to the seal for the seal functions in a manner similar to that of a shaft seal.

In addition, the lid can be removed and replaced without distorting or removing the seal down the sewer, thereby eliminating the possibility of the seal accidentally being dislodged and dropped down the sewer, where it could clog the sewer or damage pumps. When the cover is raised through use of a bar engaged with the pry slot provided in the lid, the lid immediately moves out of engagement with the seal or gasket so that the lid will be positioned on the outer and internal diameter of the manhole frame leaving the seal in its original position. Similarly, to reinstall the lid, it can be slid back into place without sliding against the seal until the lid falls into its final position where it will engage and compress the seal.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
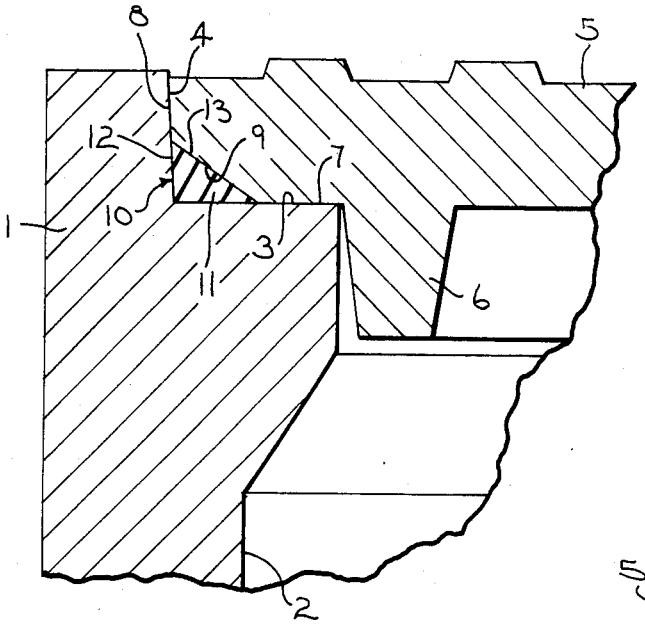
FIG. 1 is a vertical section showing a manhole lid mounted on the manhole frame.
Figure 2:
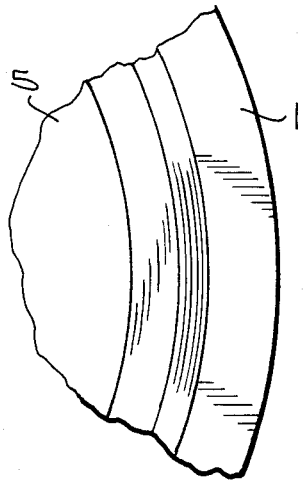
FIG. 2 is a fragmentary top plan view with parts broken away showing the lid and frame.

FIG. 1 shows a cast iron manhole frame 1 that defines or borders a manhole 2. Frame 1 is provided with an upwardly facing ledge or shoulder 3 which is bordered by an annular surface 4.

Mounted on ledge 3 is a cast iron lid or cover 5 and lid 5 is provided with a downwardly extending annular flange 6 which is located inwardly of the frame 1.

As best illustrated in FIG. 1, lower surface 7 of lid 5 rests on ledge 3, while the outer peripheral surface 8 of the lid is disposed in proximate relation to surface 4 of frame 1.

Surfaces 7 and 8 of lid 5 are connected by an angular surface 9 which bears against an annular gasket or seal 10 that is located in the corner between surfaces 3 and 4.

Figure 3:
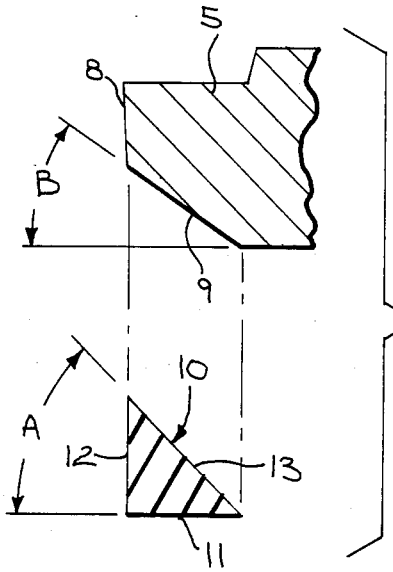
FIG. 3 is an enlarged exploded view showing the lid and seal.

As best shown in FIG. 3, seal 10 has a lower horizontal surface 11 that engages ledge 3 and extends radially less than one half the radial dimension of ledge 3. Seal 10 also has a outer peripheral surface 12 which bears against surface 4 on the frame. Connecting surfaces 11 and 12 is a diagonal surface 13 which is positioned at an angle A of 30° to 60° with respect to the horizontal and preferably about 45°.

The angular surface 9 on lid 5 is located at an angle B of about 20° to 50° with respect to the horizontal and preferably about 30°. Thus, there is a difference in angularity of about 5° to 15° between the surfaces 13 and 9 and preferably a difference in angularity of about 10°. This difference in angularity results in the lid 5, when seated on ledge 3, compressing the seal to provide a positive seal between the lid 5 and the frame 1.

Seal 10 can be mounted on ledge 3 without the use of an adhesive or sealant.

When the lid 5 is pried upwardly for removal the lid will drag along the surfaces of frame 1 but will not drag or ride against gasket 10 so that there is no possibility of the gasket being dislodged as the lid is removed, nor is there any possibility of the gasket being abraded or torn. Similarly, when the cover is re-installed the cover will slide against the surfaces of the frame, not against the gasket 10, until the lid 5 is fully seated on ledge 3.

As lid 5 is supported on ledge 3, rotation of the lid due to vehicular traffic will not bear against seal 10 and the seal will function in a manner similar to a shaft seal. Thus, rotation of the lid will not cause wear or tearing of seal 10.

Various modes of carrying out the invention are contemplated as being within the scope of the following claims particularly pointing out and distinctly claiming the subject matter which is regarded as the invention.

I claim:

1. A manhole assembly, comprising an annular frame defining a manhole and having an upwardly facing ledge and having an annular surface bordering the outer extremity of said ledge, a lid to enclose the manhole and having a lower surface to seat directly on said ledge and having an outer peripheral surface abutting said annular surface, said lid also having an angular surface connecting said lower surface and said outer peripheral surface and disposed at an acute angle with respect to the horizontal, and an annular gasket for sealing the lid to said frame, said gasket being generally triangular in cross section and including a first surface resting on said ledge, a second surface disposed in contact with said annular surface of said frame and a third diagonal surface connecting said first and second surfaces, said third surface disposed at an angle with respect to the horizontal 5° to 15° greater than said acute angle.

2. The manhole assembly of claim 1, wherein said third surface is disposed at an angle with respect to the horizontal 10° greater than said acute angle.

3. The manhole assembly of claim 1, wherein said third surface is disposed at an angle of about 45° with respect to the horizontal and said angular surface is disposed at an angle of 35° with respect to said horizontal.

4. The manhole assembly of claim 1, wherein the radial dimension of said first surface is less than one half the radial dimension of said ledge.

5. A manhole assembly, comprising an annular frame defining a manhole and having an upwardly facing ledge and having an annular surface bordering the outer extremity of said ledge, a lid to enclose the manhole and having a lower surface to seat directly on said ledge and having an outer peripheral surface abutting said annular surface, said lid also including an angular surface interconnecting said lower surface and said outer peripheral surface and disposed at an acute angle to the horizontal, and a resilient annular sealing member for sealing the lid to said frame, said sealing member having a generally triangular cross section and including a first surface resting on said ledge, a second surface disposed in engagement with said annular surface and a third diagonal surface connecting said first and second surfaces, said third surface being engaged with said angular surface, said third surface being disposed at an angle with respect to the horizontal 5° to 15° greater than said acute angle.

* * * * *